US009318254B2

(12) United States Patent
Andersson et al.

(10) Patent No.: US 9,318,254 B2
(45) Date of Patent: Apr. 19, 2016

(54) INDUCTOR CORE, AN ARRANGEMENT FOR A PRESS, AND A MANUFACTURING METHOD

(75) Inventors: Ola Andersson, Nyhamnsläge (SE); Mats Larsson, Lerberget (SE); Peter Rauch, Feldkirch (AT)

(73) Assignee: HOGANAS AB (PUBL), Hoganas (SE)

( * ) Notice: Subject to any disclaimer, the term of this patent is extended or adjusted under 35 U.S.C. 154(b) by 14 days.

(21) Appl. No.: 14/115,535

(22) PCT Filed: May 2, 2012

(86) PCT No.: PCT/EP2012/057981

§ 371 (c)(1), (2), (4) Date: Nov. 4, 2013

(87) PCT Pub. No.: WO2012/150236

PCT Pub. Date: Nov. 8, 2012

(65) Prior Publication Data

US 2014/0077920 A1 Mar. 20, 2014

Related U.S. Application Data

(60) Provisional application No. 61/483,838, filed on May 9, 2011.

(30) Foreign Application Priority Data

May 5, 2011 (EP) ..... 11164949

(51) Int. Cl.
*H01F 27/24* (2006.01)
*H01F 27/30* (2006.01)
(Continued)

(52) U.S. Cl.
CPC ..... *H01F 27/255* (2013.01); *H01F 17/043* (2013.01); *H01F 41/0246* (2013.01)

(58) Field of Classification Search
CPC ..... H01F 17/04; H01F 27/255; H01F 1/344; H01F 41/0246; H01F 1/24
USPC ..... 336/233, 198, 208
See application file for complete search history.

(56) References Cited

U.S. PATENT DOCUMENTS 2,628,342 A * 2/1953 Taylor ..... 336/45
3,609,615 A * 9/1971 Parker et al. ..... 336/178
(Continued)

FOREIGN PATENT DOCUMENTS

DE 970 288 C 9/1958
DE 19 14 268 A1 10/1970
(Continued)

OTHER PUBLICATIONS

Yagi et al., "Magnetic Properties of Fe-Based Amorphous Powder Cores Produced by a Hot-Pressing Method" Journal of Magnetism and Magnetic Materials, Elsevier Science Publishers, Amsterdam, NL, (Jun. 1, 2000), vol. 215-216, pp. 284-287.
(Continued)

*Primary Examiner* — Elvin G Enad
*Assistant Examiner* — Kazi Hossain
(74) *Attorney, Agent, or Firm* — Buchanan Ingersoll & Rooney P.C.

(57) ABSTRACT

Inductor core including: a base core portion having a first surface and an opposite second surface; an inner core portion extending from the first surface in a direction transverse to the first surface; an outer core portion extending, in the direction transverse to the first surface, from the first surface to an end surface of the outer core portion, the outer core portion at least partly surrounding the inner core portion, thereby forming a space around the inner core portion for accommodating a winding; wherein the first surface includes a recess for accommodating a connection portion of the winding, said recess extending at least a part of a distance between the inner core portion and the outer core portion, and wherein the outer core portion presents a slit extending from said end surface towards the recess, and wherein the second surface comprises a first protrusion oppositely arranged to the recess.

12 Claims, 9 Drawing Sheets

(51) Int. Cl.

| | |
|---|---|
| ***H01F 27/29*** | (2006.01) |
| ***H01F 27/255*** | (2006.01) |
| ***H01F 17/04*** | (2006.01) |
| ***H01F 41/02*** | (2006.01) |

(56) References Cited

U.S. PATENT DOCUMENTS

| | | | | |
|---|---|---|---|---|
| 5,134,770 | A | 8/1992 | Yerman et al. | |
| 5,726,615 | A * | 3/1998 | Bloom | 336/83 |
| 5,844,459 | A * | 12/1998 | Larsen | 336/92 |
| 6,522,233 | B1 * | 2/2003 | Kyoso et al. | 336/200 |
| 6,707,366 | B2 * | 3/2004 | Hsu et al. | 336/200 |
| 2005/0225418 | A1 * | 10/2005 | Tran-Ngoc et al. | 336/198 |
| 2007/0057757 | A1 * | 3/2007 | Chen et al. | 336/212 |
| 2007/0171023 | A1 * | 7/2007 | Ikezawa | 336/208 |
| 2010/0237978 | A1 | 9/2010 | Brunner et al. | |

FOREIGN PATENT DOCUMENTS

| | | | |
|---|---|---|---|
| DE | 001914268 | A1 * | 10/1970 |
| DE | 16 14 550 | B1 | 8/1972 |
| DE | 24 31 853 | A1 | 1/1976 |
| DE | 34 32 812 | A1 | 3/1986 |
| DE | 10 2006 032517 | A1 | 1/2008 |
| EP | 1 681 689 | A1 | 7/2006 |
| JP | EP001681689 | A1 * | 7/1996 |

OTHER PUBLICATIONS

International Search Report (PCT/ISA/210) mailed on Jun. 13, 2012, by the European Patent Office as the International Searching Authority for International Application No. PCT/EP2012/057981.

Written Opinion (PCT/ISA/237) mailed on Jun. 13, 2012, by the European Patent Office as the International Searching Authority for International Application No. PCT/EP2012/057981.

* cited by examiner

INDUCTOR CORE, AN ARRANGEMENT FOR A PRESS, AND A MANUFACTURING METHOD

TECHNICAL FIELD

The present inventive concept relates to an inductor core, an arrangement for a press and a manufacturing method.

BACKGROUND OF THE INVENTION

Inductors are used in a wide array of applications such as signal processing, noise filtering, power conversion, electrical transmission systems etc. In order to provide more compact and more efficient inductors, the electrically conducting winding of the inductor may be arranged in a magnetically conducting core, i.e. an inductor core.

Inductor cores may be manufactured by pressing a soft magnetic powder material, e.g. an iron powder. The powder may be put into a cavity wherein the powder may be compacted. In some cases it may be desirable to compress the soft magnetic material powder to a high density in order to e.g. increase the magnetic saturation of the final inductor core etc. During manufacturing, this may be accomplished by increasing the pressure applied by the punches. The maximum possible pressure is limited inter alia by the capacity of the press, the size of the inductor core and the type of powder material which is being compressed.

Inductor cores may be manufactured in a variety of designs. FIGS. 1*a* and 1*b* illustrate a prior art inductor core 10. In the prior art, this design is sometimes referred to as a pot core design. The inductor core 10 includes a base core portion 11 from which an outer core portion 12 and an inner core portion 13 extend in an axial direction. The winding (left out for simplicity) may be arranged around the inner core portion 13. The base core portion 11 may include a recess 14 and the outer core portion 12 may include an axially extending slit 15. The purpose of the recess 14 is to accommodate a connection portion of the winding e.g. for connecting the winding to electrical components exterior of the inductor core 10. The purpose of the slit 15 is to provide a lead-through for the connection portion of the winding in the outer core portion 12. By virtue of the recess 14, the connection portion will not occupy any valuable winding space within the inductor core 10 wherein a high winding fill factor may be achieved.

The basic geometry of the inductor core, i.e. without any recess 14 and any slit 15, may be comparably quickly and efficiently manufactured in a single pressing operation. It would be desirable to be able to form also the inductor core 10 in single pressing operation. However, the presence of the recess 14 and the slit 15 complicates the geometry and the structure of the inductor core 10 and affects the manufacturing process. More specifically, the inventors have noticed that the punch responsible for pressing the base core portion 11 and the recess 14 becomes biased during pressing wherein the punch bends through the slit 15 and is pressed against the wall of the die. It has further been noticed that this problem becomes increasingly severe as the pressing force is increased and the size of the inductor core is increased.

One way to avoid this problem is to form the recess 14 in the base core portion 11 and the slit 15 in the outer core portion 12 by a milling process after an inductor core having the above-mentioned basic geometry has been pressed. However, a separate milling process increases the total manufacturing time and also requires additional tools, other than pressing tools, for completing the pot core. Moreover, depending on the geometry of the inductor core and the material choice it may in some cases not be practically possible to mill a recess 14 and a slit 15 to a desired shape.

Another way to avoid this problem is to form the inductor core 10 in a press which, in addition to a first set of punches forming the overall structure of the inductor core 10, also includes an additional punch for forming the recess 14 and the slit 15, which additional punch is independently controllable from the first set of punches. However, this results in a much more complicated and expensive press and tooling.

Thus, there is need in the prior art for an inductor core with a recess and a slit which is more cost-efficient and simpler to manufacture with a high efficiency.

SUMMARY OF THE INVENTION

In view of the above, an object of the present inventive concept is to meet this need in the prior art. According to a first aspect of the present inventive concept, this and other objects are achieved through an inductor core made of a compressed soft magnetic powder material. The inductor core comprises: a base core portion having a first surface and an opposite second surface; an inner core portion extending from the first surface in a direction transverse to the first surface; an outer core portion extending, in the direction transverse to the first surface, from the first surface to an end surface of the outer core portion, the outer core portion at least partly surrounding the inner core portion, thereby forming a space around the inner core portion for accommodating a winding; wherein the first surface comprises a recess for accommodating a connection portion of the winding, said recess extending at least a part of a distance between the inner core portion and the outer core portion, and wherein the outer core portion presents a slit extending from said end surface towards the recess, and wherein the second surface comprises a first protrusion oppositely arranged to the recess.

This inventive design makes it possible to obtain a volume and weight efficient inductor core in a cost-efficient and comparably simple manner. By virtue of the recess and the slit, the connection portion of the winding may be conveniently arranged to extend through the slit and in the recess without occupying any valuable winding space within the inductor core.

Moreover, the first protrusion oppositely arranged to the recess makes it possible to manufacture an inductor core including a recess and a slit in a single pressing operation i.e. without requiring any aftermachining (such as a separate milling process). Furthermore, this may be achieved using a comparably simple press, e.g., without requiring the above-mentioned additional independently controllable punch.

The inventors have realized that the first protrusion thereby enables the base portion as well as the recess and the slit to be formed in a single operation using a single punch (e.g. presenting a projection for forming the recess on the first surface of the base core portion) and a corresponding counter punch (e.g. presenting a depression for forming the first protrusion on the second surface of the base core portion). The first protrusion adds to the second surface at least some of the volume which is occupied by the recess, i.e. lost in the base core portion in order to form the recess, and thereby makes formation of the base core portion possible by reducing any biasing of the punch which otherwise would be caused by the presence of the recess. Consequently, the inductor core may be manufactured in a cost and time efficient manner using a relatively simple press.

Had one attempted forming a base core portion including a recess but without any corresponding first protrusion by using a single punch and counter punch the powder at the recess would be compressed more than the powder forming the other parts of the base portion. For larger pressing forces, this could lead to large density variations in the base core portion which could cause local over-pressing and fissuring. In view of this, a bonus effect brought about by the first protrusion is that the density variations in the base core portion may be advantageously limited wherein a larger pressing force may be applied during manufacturing with a reduced risk of fissuring.

According to one embodiment of the present invention, the first protrusion is coextensive with at least a part of the recess by extending along at least a part of the recess. Thus an inductor core may be obtained wherein the recess in the first surface may be compensated for by a corresponding first protrusion on the second surface. It thus becomes possible to manufacture the base core portion of the inductor core with a more uniform material density while minimizing any bias on the punch forming the base core portion during manufacture.

According to one embodiment the first protrusion extends to an outer edge of the second surface of the base core portion.

According to one embodiment the recess extends from the inner core portion.

According to one embodiment the recess presents an increasing depth along a direction away from the inner core portion. Thereby, a recess may be provided while preserving the flux conducting cross sectional area of the base core portion close to the inner core part where the available flux conducting cross sectional area generally is the smallest.

According to one embodiment the recess extends to an outer edge of the first surface of the base core portion. Thereby, the volume of the winding space occupied by the connection portion of the winding may be advantageously reduced.

According to one embodiment the slit extends to the recess such that the slit joins the recess wherein the recess forms the bottom of the slit. Thereby, the volume of the winding space occupied by the connection portion of the winding may be advantageously reduced.

According to one embodiment the width of the slit equals or exceeds the width of the recess at the outer edge of the first surface of the base core portion.

According to one embodiment a width of the first protrusion equals or exceeds a width of the recess.

According to one embodiment the wall portions of the outer core portion defining the slit extend in parallel with the direction transverse to the first surface. This may simplify manufacturing of the inductor core and enables use of punches of a simple geometry.

According to an alternative embodiment, the width of the slit decreases in a direction towards the recess.

According to one embodiment the second surface further comprises a center protrusion arranged directly opposite the inner core portion. The center protrusion may enable a stable attachment of the inductor core since the area of contact between the second surface and a mounting surface may be increased. This may also enable increased heat dissipation from the inductor core to the mounting surface.

According to one embodiment the center protrusion presents a dimension in the plane of the second surface which is equal to or exceeding a dimension of the inner core portion in the direction transverse to the first surface.

According to one embodiment, the first protrusion extends between the center protrusion and an outer edge of the second surface of the base core portion, said first protrusion thereby joining the center protrusion.

According to one embodiment an extension of said first protrusion in a direction transverse to the second surface meets or exceeds an extension of the center protrusion in the direction transverse to the second surface.

According to one embodiment the second surface further comprises a rim protrusion extending along an outer edge of the second surface of the base core portion. Similar to the center protrusion, the rim protrusion may enable a stable attachment of the inductor core to a mounting surface since the contact surface between the second surface and the mounting surface thereby may be increased. This may also enable increased heat dissipation from the inductor core.

According to one embodiment an extension of the rim protrusion in a direction transverse to the second surface equals or exceeds an extension of the first protrusion in the direction transverse to the second surface.

According to one embodiment the first surface comprises at least two recesses, said at least two recesses extending at least a part of a distance between the inner core portion and the outer core portion, and wherein the second surface, for each of said at least two recesses, comprises a protrusion oppositely arranged to a corresponding recess. Similar to the center protrusion and the rim protrusion, adding additional pairs or recesses and protrusions may enable a more stable attachment of the inductor core since the contact surface between the second surface and a mounting surface thereby may be increased. This may also enable increased heat dissipation from the inductor core.

According to one embodiment the at least two recesses and the corresponding protrusions present a symmetric angular distribution on the first and second surfaces. This may further improve the stability when attaching the inductor core to a mounting surface.

According to one embodiment a density in a first part of the base core portion including any of the above-mentioned recesses differs from a density in a second part of the base core portion not including any recess by 10% or less, and more preferably by 5% or less, and most preferably by 2.5% or less. As mentioned above, the first protrusion adds to the second surface at least some of the material volume of the base core portion which is occupied by the recess, i.e. lost in order to form the recess. The greater the correspondence between the recess and the first protrusion, the lesser density variations may be achieved.

According to one embodiment the dimension of the outer core portion in the direction transverse to the first surface exceeds the dimension of the inner core portion in the direction transverse to the first surface. According to a further aspect there is provided an inductor core combination comprising two such inductor cores, wherein the end surface of the outer core portion of the first inductor core engages with the end surface of the outer core portion of the second inductor core, and wherein the inner core portions together form an elongated inner core portion presenting an air gap. In some applications it may be desirable to use an inductor core including an air gap since a properly arranged air gap inter alia may reduce the inductance sensitivity to current variations.

According to one embodiment, the compressed soft magnetic powder material includes preferably at least 80% by weight of iron, more preferably at least 90% by weight of iron, and most preferably at least 95% by weight of iron. An increased percentage of iron may improve the compressibility of the powder. The present inventive inductor core may be conveniently formed in a comparably simple pressing operation as discussed above from a powder of high compressibility whereas forming the prior art inductor core from a powder of high compressibility would result in an increased biasing of the punch.

According to a further aspect there is provided an arrangement for a press for manufacturing an inductor core from soft magnetic powder material, the arrangement comprising:

an inner punch arranged to apply a first pressing force in a first pressing direction, a middle punch arranged to apply a second pressing force in the first pressing direction, the middle punch including a space extending in the first pressing direction and being arranged to receive at least a portion of the inner punch, the middle punch further presenting a first portion projecting in the first pressing direction and a second portion projecting in an outward direction transverse to the first pressing direction and extending along the first pressing direction, an outer punch arranged to apply a third pressing force in the first pressing direction, the outer punch including a space extending in the first pressing direction and being arranged to receive at least a portion of the middle punch, the outer punch further including a slit extending in the first pressing direction and leading into said space and being arranged to receive at least a portion of the second projection, a counter punch arranged to be aligned with the inner punch, the middle punch and the outer punch along the first pressing direction, the counter punch further arranged to apply a fourth pressing force in a second pressing direction opposite the first pressing direction to generate a counter force to the first, the second and the third pressing forces, the counter punch further including a depression, wherein the common punch is arranged such that the depression is aligned with the first portion of the middle punch, and a die including a space arranged to receive at least a portion of the outer punch, the middle punch, the inner punch and the counter punch.

The inner punch, the middle punch, the outer punch and the counter punch may be independently controllable.

The inventive arrangement may be used to form an inductor core in accordance with the first aspect in a single pressing operation. By virtue of the counter punch including a depression arranged such that the depression is aligned with the first projecting portion of the second punch, an inductor core including a base portion presenting a recess may be formed with a reduced risk of biasing of the middle punch. Furthermore, the second projecting portion in combination with the slit of the outer punch makes it possible to form an outer core portion including a slit in a single pressing operation.

According to a further aspect there is provided a method for manufacturing an inductor core, comprising:

providing a soft magnetic powder composite in a cavity including a first partial volume for forming an inner core portion, a second partial volume for forming an outer core portion including a slit, and a third partial volume for forming a base core portion including a recess on a first side of the base core portion, and simultaneously compressing the powder in the first, the second and the third partial volumes along a common axis to form the inductor core using a punch arranged to form a protrusion on a second side of the base core portion which second side is opposite the first side, wherein the protrusion is formed directly opposite the recess.

The advantages of this aspect correspond to those of the inductor core aspect and the arrangement aspect, wherein reference is being made to the above discussion.

BRIEF DESCRIPTION OF THE DRAWINGS

The above, as well as additional objects, features and advantages of the present inventive concept, will be better understood through the following illustrative and non-limiting detailed description of preferred embodiments of the present inventive concept, with reference to the appended drawings, where like reference numerals will be used for like elements, wherein.

DETAILED DESCRIPTION OF PREFERRED EMBODIMENTS

Figure 1A:
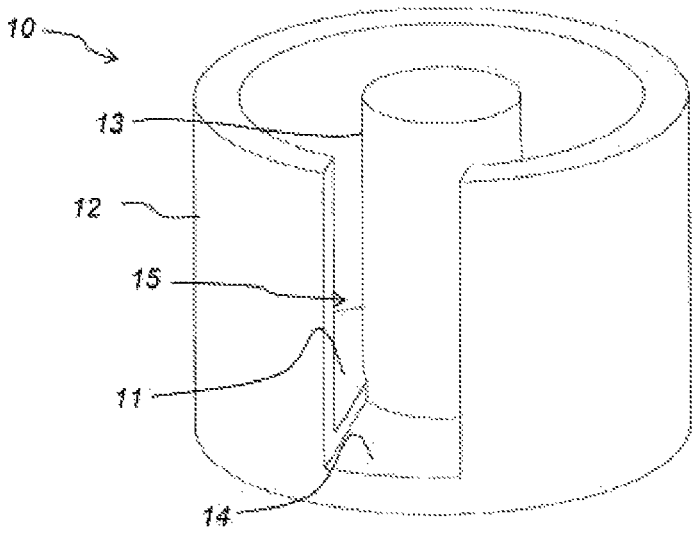
FIGS. 1*a* and 1*b* are perspective views illustrating a prior art inductor core.
Figure 1B:
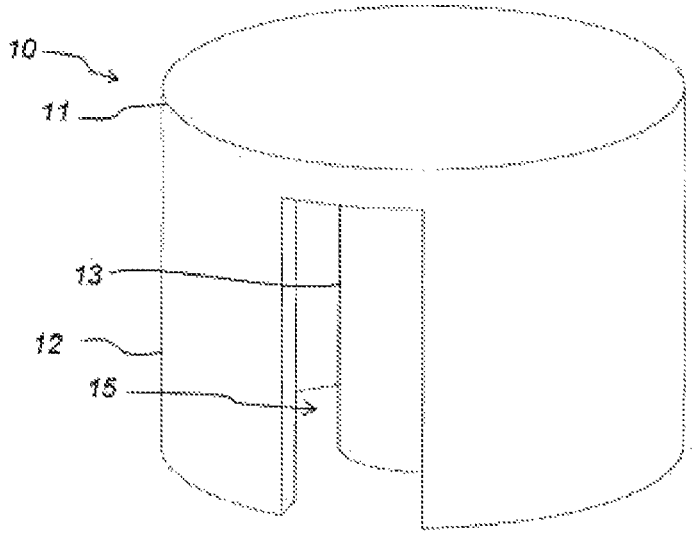

An embodiment of an inductor core 20 according to the present inventive concept will now be described with reference to FIGS. 2*a* and 2*b*.

The inductor core 20 may be made of a compressed soft magnetic powder material. The powder material may be a ferrite powder, a high purity iron powder, a Fe—Si powder, other silicon-alloyed powders, an iron-phosphorous alloy or some other powder material with similar properties. Optionally, the material may be a soft magnetic composite powder material including a soft magnetic powder (e.g. iron) provided with an electrically insulating coating. Examples of composite materials that may be used are Somaloy 110i, Somaloy 130i, Somaloy 500, Somaloy 700 and Somaloy 1000 which may be obtained from Höganäs AB, S-263 83, Höganäs, Sweden.

The inductor core 20 comprises a disc-shaped base core portion 21, extending in a radial direction. The base core portion 21 includes a first surface 21*a* and a second surface 21*b* opposite to the first surface 21*a*. The inductor core 20 further comprises an inner core portion 23, extending perpendicularly from the first surface 21*a*, thereby defining a longitudinal direction, i.e. an axial direction. The inner core portion 23 has a circularly shaped cross section. The inductor core 20 further comprises an outer core portion 22 extending in the axial direction from the first surface 21*a* towards an end surface 26 of the outer core portion 22.

The inner core portion 23 extends from a centre part of the base core portion 21. The outer core portion 22 extends from a radially outer part of the base core portion 21. The outer core portion 22 forms a circumferential housing of the inductor core 20.

Figure 2A:
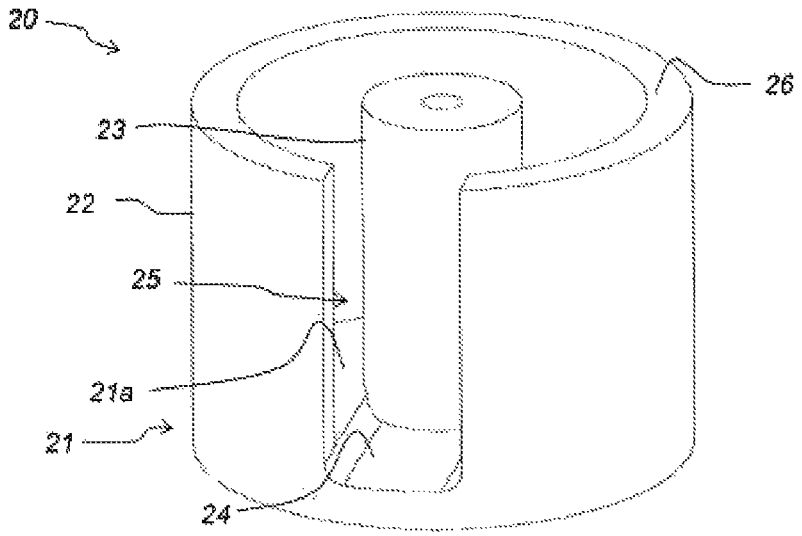
FIGS. 2*a* and 2*b* are perspective views illustrating an embodiment of an inductor core according to the present inventive concept.
Figure 2B:
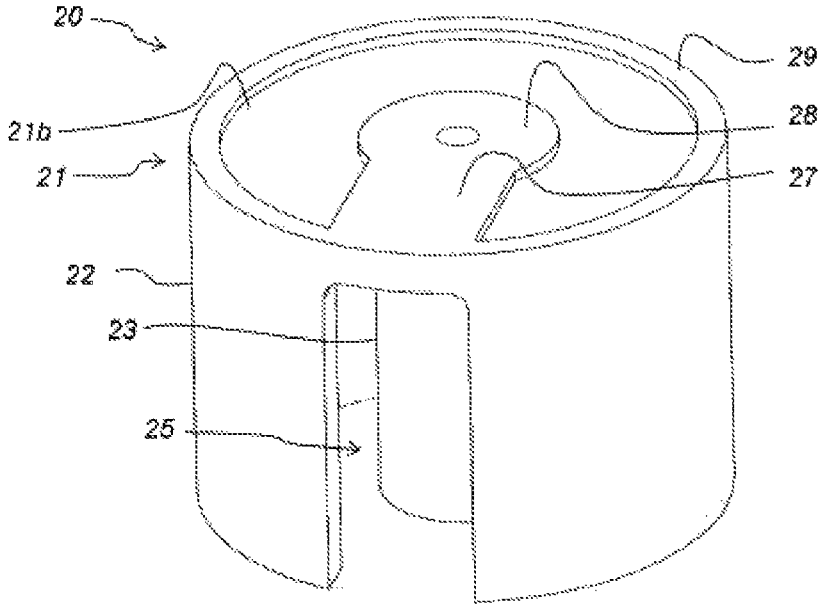

As indicated in FIGS. 2*a* and 2*b* the inner core portion 23 may be provided with an axially extending hole. The hole may be a through-hole. The hole may be arranged to receive fastening means, such as a bolt or the like, for attaching the inductor core 20 to an outer structure.

As illustrated in FIGS. 2*a* and 2*b*, the outer core portion 22 at least partly surrounds the inner core portion 23 in a radial direction. Thereby, an annular space extending radially and axially between the inner core portion 23 and the outer core portion 22 is formed. In this space, a winding may be arranged. For example, one or more windings may be wound around the inner core portion 23 a plurality of times.

The outer core portion 22 includes a slit 25. The slit 25 extends from the end surface 26 towards the first surface 21*a*. The slit 25 extends through the full radial thickness of the outer core portion 22 and thereby extends into the winding space. The wall portions of the outer core portion 22 defining the slit 25 extend in parallel with the axial direction.

The first surface 21*a* includes a single recess 24 extending in the radial direction from the inner core portion 23 towards the slit 25, thereby joining the slit 25 wherein the recess 24 forms the bottom of the slit 25. At the radial position where the recess 24 joins the slit 25, the recess 24 and the slit 25 have approximately equal widths, i.e. equal angular dimensions.

The recess 24 is arranged to accommodate one or more connection portions of one or more windings arranged around the inner core portion 23. Especially, the connection portion of the inner turn winding may be arranged in the recess 24. The slit 25 is arranged to provide a lead-through for a connection portion in the outer core portion 22. Connection portions of windings may thus be arranged through the slit 25 and along the first surface 21*a* of the base core portion 21 to the inner core portion 23 while occupying a minimum volume of the winding space.

The second surface 21*b* comprises a protrusion 27. The protrusion 27 protrudes in the axial direction. The protrusion 27 extends in a radial direction from a central part of the second surface 21*b* towards an outer radial edge of the second surface 21*b*. The protrusion 27 is coextensive with the recess 24 by extending along, and in parallel with the recess 24.

Figure 3:
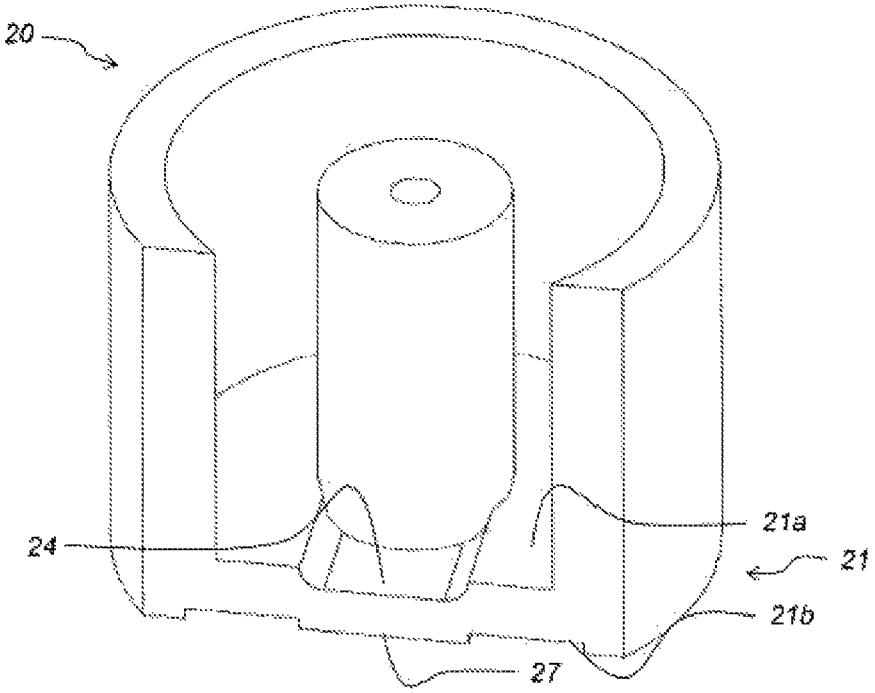
FIG. 3 is a sectional view of an inductor core according to one embodiment.

FIG. 3 is a sectional view of the inductor core 20, taken perpendicular to the radial extension of the recess 24 and the protrusion 27. As may be seen, the recess 24 and the protrusion 27 are arranged directly opposite each other. The recess 24 presents a transverse profile along the section surface. The protrusion 27 presents a corresponding transverse profile along the section surface. The profile of the recess 24 and the profile of the protrusion 27 together determine the material thickness of the part of the base core portion 21 in which the recess 24 and the protrusion 27 are provided.

The relative material thickness of the base core portion 21 in the region of the recess may vary depending on the specific choice of powder material and the density of the finished inductor core. At any rate, the protrusion 27 adds to the second surface 21*b* at least some of the material thickness lost on the first surface 21*a* to provide the recess 24.

In the following, $\rho_1$ denotes the density in a first part of the base core portion 21 between the recess 24 and the protrusion 27 and $\rho_2$ denotes the density in a second part of the base core portion 21 not including any recess, i.e. outside any recess. The first and the second part of the base core portion 21 is a part located between the inner core portion 23 and the outer core portion 22. In terms of the cylindrical geometry of the inductor core 20, the first and second parts of the base core portion 21 may be parts of the annularly shaped segment of the base core portion 21 located radially between the inner core portion 23 and the outer core portion 22.

$\rho_1$ may be a mean density of the first part of the base core portion 21. Alternatively, $\rho_1$ may be a maximum density of the first part of the base core portion 21. Analogously, $\rho_2$ may be a mean density of the second part of the base core portion 21. Alternatively, $\rho_2$ may be a maximum density of the second part of the base core portion 21.

For an inductor core formed in a single pressing operation, $\rho_1$ may, due partly to the recess 24, differ from $p_2$ to some degree. In other words, $\Delta\rho=(\rho_1-\rho_2)/\rho_2$ may be greater than 0. By virtue of the combination of the recess 24 and the protrusion 27, the density difference $\Delta\rho$ may be advantageously limited. According to one example, $\Delta\rho$ may be 10% or less, e.g. the density difference $\Delta\rho$ may be substantially 0% to 10%. In other words, $\rho_1/\rho_2$ may be 1 to 1.1. According to another example, the density difference $\Delta\rho$ may be 5% or less, e.g. substantially 0% to 5%. In other words, $\rho 1/\rho 2$ may be 1 to 1.05. According to another example, the density difference $\Delta\rho$ may be 2.5% or less, e.g. substantially 0% to 2.5% In other words, $\rho_1/\rho_2$ may be 1 to 1.025. According to an even further example the first part and the second part of the base core portion 21 may have similar densities. In other words the segment of the base core portion 21 extending between the inner core portion 23 and the outer core portion 22 may have a substantially uniform density.

Returning to embodiment illustrated FIG. 3, the edges of the recess 24 are chamfered. The recess 24 thus presents a width which decreases along the axial direction, from the level of the first surface 21*a* to the level of the bottom of the recess 24. The chamfer of the recess 24 may reduce the risk of damaging any insulation of the connection portion of the winding. Although not shown in FIG. 3, also the edges of the protrusion 27 may be chamfered. The protrusion 27 may thus present a width which decreases along the axial direction, from the level of the second surface 21*b* to the level of the top surface of the protrusion 27. These smooth transitions may simplify manufacturing of the inductor core 20 by reducing the risk of fissuring in the base core portion 21 due to abrupt or sharp edges.

As illustrated in FIG. 2*b*, the second surface 21*b* presents a centrally arranged circular protrusion 28. The center protrusion 28 protrudes in a direction transverse to the second surface 21*b*. The center protrusion 28 is arranged directly opposite the inner core portion 23. The center protrusion 28 presents an extension in the plane of the second surface 21*b* which extension is substantially equal to the radial extension of the inner core portion 23. In terms of the cylindrical geometry of inductor core 20, the radius of the central projection 28 is thus approximately equal to the radius of the inner core portion 23. The protrusion 27 extends from the center protrusion 28 and thus joins the center protrusion 28 at an outer edge of thereof.

According to an alternative design, the center protrusion 28 may instead present an annular shape. The larger radius may be substantially equal to, or larger than, the radial extension of the inner core portion 23. The smaller radius may be substantially equal to, or smaller than, the radial extension of the inner core portion 23. An annularly shaped center protrusion may provide a stable mounting surface while using less material than a circular protrusion.

Returning to FIG. 2*b*, the second surface 21*b* further presents a rim protrusion 29 extending along an outer edge of the second surface of the base core portion 21. The rim protrusion 29 protrudes in a direction transverse to the second surface 21*b*. The rim protrusion 29 is arranged directly opposite the outer core portion 22. The rim protrusion 29 presents a thickness in the radial direction which is substantially equal to the radial thickness of the outer core portion 22. Alternatively, the thickness of the rim protrusion 29 may be smaller or larger than the thickness of the outer core portion 22.

The rim protrusion 29 extends from a first side of the protrusion 29, along the circumference of the second surface 21*b*, to a second side of the protrusion 29 which is opposite the first side of the protrusion 29. The rim protrusion 29 thus joins the protrusion 27 at an outer part thereof.

The protrusion 27 extends from the center protrusion 28 to the outer edge of the second surface 21*b*. The protrusion 27, the center protrusion 28 and the rim protrusion 29 together form a common protruded surface of the second surface 21*b*. The axial extension of the rim protrusion 29 approximately equals the axial extension of the protrusion 27. The axial extension of the center protrusion 28 approximately equals the axial extension of the protrusion 27.

Figure 4:
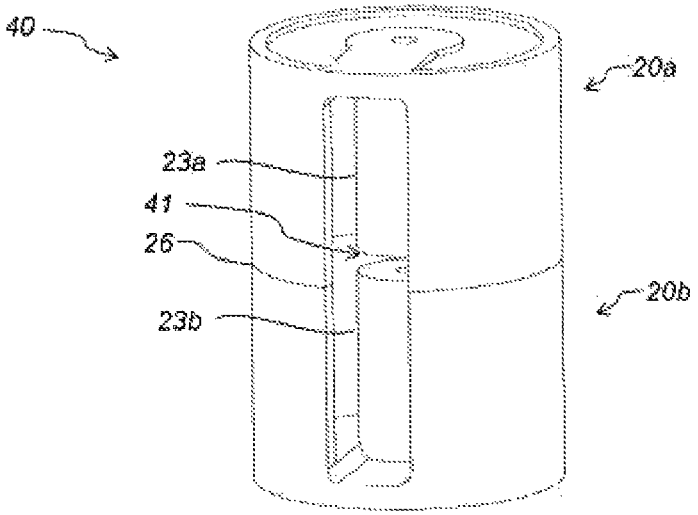
FIG. 4 is schematically illustrates an inductor core combination according to one embodiment.

To obtain a closed inductor core, a lid may be arranged on the top surface 26 of the inductor core 20. The shape of the lid may vary depending on the geometry of the inductor core. For the cylindrical geometry of the inductor 20 a disc-shaped lid may be appropriate. Alternatively, and as illustrated in FIG. 4, two inductor cores 20*a* and 20*b*, each being similar to the inductor core 20, may be arranged such that their respective end surfaces 26, engage with each other. Optionally, the axial extension of the outer core portion 22 of at least one of the inductor cores 20*a*, 20*b* may exceed the axial extension of the corresponding inner core portion 23*a*, 23*b* such that an inductor core combination 40 comprising an elongated inner core portion including an axially extending gap 41 is formed.

In the above, the inventive concept has mainly been described with reference to a specific embodiment. However, as is readily appreciated by a person skilled in the art, other embodiments than the ones disclosed above are equally possible.

For example, the center protrusion 28 and/or the rim protrusion 29 may be regarded as optional features. Hence, there is provided an alternative embodiment of an inductor core similar to the inductor core 20 however not including a rim protrusion 28 and/or a center protrusion 29.

According to a further example, the recess 24 and the protrusion 27 need not extend in a straight radial direction. Instead, an inductor may be provided which includes a recess and a protrusion extending in a curved fashion between the inner core portion and the outer core portion.

According to a further example, the recess 24 and the protrusion 27 need not present a constant width. Instead, an inductor may be provided which includes a recess and a protrusion presenting a width which increases or decreases along a radially outward direction.

Figure 5A:
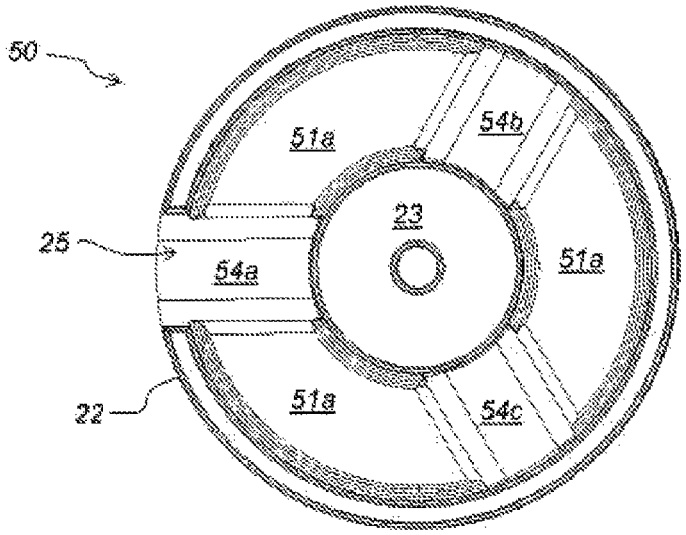
FIGS. 5*a* and 5*b* are top views and bottom views, respectively, of an inductor core according to a further embodiment.
Figure 5B:
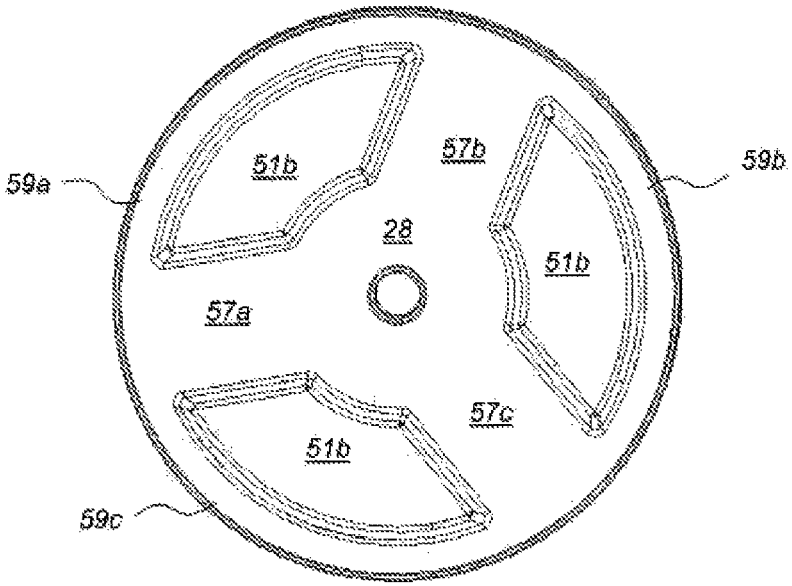

FIG. 5*a* is a top-view illustration of an inductor core 50 according to a further embodiment. FIG. 5*b* is a bottom-view illustration of the inductor core 50. The inductor core 50 is similar to the inductor core 20 however differs in that it includes more than one recess and more than one corresponding protrusion. More specifically, the base core portion of the inductor core 50 includes a first surface 51*a* and an opposite second surface 51*b*. The first surface 51*a* includes three recesses 54*a*, 54*b*, 54*c*. The recesses are symmetrically distributed on the first surface 51*a* with respect to an angular direction such that an angle of approximately 120° is formed between adjacent pairs of recesses. However other distributions are also possible. The second surface 51*b* includes three protrusions 57*a*, 57*b*, and 57*c*. Protrusion 57*a* is arranged directly opposite the recess 54*a*. Protrusion 57*b* is arranged directly opposite the recess 54*b*. Protrusion 57*c* is arranged directly opposite the recess 54*c*. The recesses 54*a*, 54*b*, 54*c* partition the first surface 51*a* into three sector-shaped regions. Correspondingly, the protrusions 57*a*, 57*b*, 57*c* partition the second surface 51*b* into three sector-shaped regions.

The slit 25 extends from the end surface of the outer core portion towards the recess 54*a*. The recess 54*a* thus forms the bottom of the slit 25.

The second surface 51*b* further comprises three rim protrusions 59*a*, 59*b*, 59*c*. Each one of the rim protrusions 59*a*, 59*b*, 59*c* is arranged directly opposite the outer core portion 22. Each one of the rim protrusions 59*a*, 59*b*, 59*c* present a thickness in the radial direction which is substantially equal to the radial thickness of the outer core portion 22.

The rim protrusion 59*a* extends between the first protrusion 57*a* and the second protrusion 57*b*. The rim protrusion 59*b* extends between the protrusion 57*b* and the protrusion 57*c*. The rim protrusion 59*c* extends between the protrusion 57*c* and the protrusion 57*a*. The rim protrusions 59*a*, 59*b*, 59*c* thus join the protrusions 57*a*, 57*b*, 57*c* at an outer part thereof.

The axial extension of the rim protrusions 59*a*, 59*b*, 59*c* approximately equals the axial extension of the protrusion 27. The rim protrusions 59*a*, 59*b*, 59*c* and the radially outer parts of the protrusions 57*a*, 57*b*, 57*c* thus together define a continuous circumferential rim protrusion.

In FIGS. 5*a* and 5*b* the recesses 54*a-c* as well as the protrusions 57*a-c* are illustrated as having similar dimensions, and more specifically similar widths. However, according to an alternative, the recesses 54*a-c* as well as the protrusions 57*a-c* may have different dimensions, and more specifically different widths. Especially, the two recesses 54*b-c* may be present a smaller width than the recess 54*a*. Analogously, the two protrusions 57*b-c* may present a smaller width than the protrusion 57*a*.

It should be noted that an inductor core may include other number of recesses and protrusions than one and three as described above. For example, an inductor core may include two recesses and two corresponding protrusions. In that case, the two recesses (and the two protrusions) may be arranged at an angle of 180° in relation to each other.

In the inductor core 20 described above, the recess 24 extends from the inner core portion 23 to the slit 25. According to an alternative embodiment, the innermost radial part of the recess 24 is separated from the inner core portion 23 by a distance, i.e. a non-zero distance. This may be useful for example when using a multi-layer winding having a thickness such that the outer layer of the winding roughly coincides with the innermost radial part of the recess 24 wherein the connection portion of the winding which is to be accommodated in the recess leaves the winding at the innermost radial part of the recess 24. In that case, the corresponding protrusion 27 may be coextensive with, or shorter or longer than the recess 24.

Figure 6:
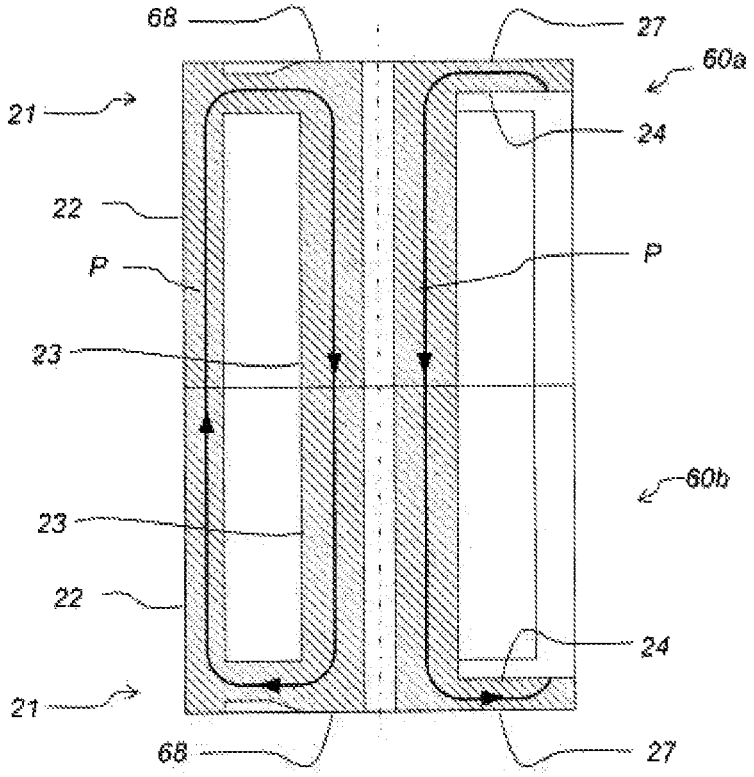
FIG. 6 is a schematic illustration of an inductor core according to a further embodiment.

FIG. 6 illustrates a section of an inductor core 60*a* and an inductor core 60*b*. The inductor core 60*a* is arranged on top of the inductor core 60*b* to obtain a closed combined inductor core. The section is taken along the center axis of the inductor cores 60*a* and 60*b*. The inductor cores 60*a* and 60*b* are similar to the inductor core 20. As illustrated in FIG. 6, the inductor cores 60*a* and 60*b* include a center protrusion 68 having a chamfered edge. The center protrusion 68 thus presents a thickness in the axial direction which decreases gradually along an outward direction. Thereby, winding space may be preserved by virtue of the recess 24 while at the same time the flux conducting cross sectional area of the base core portion 21 may be preserved close to the inner core part 23 where the available flux conducting cross sectional area is the smallest. The flux path through the inductor cores is schematically indicated by arrow P. For the embodiment shown in FIG. 6, the flux conducting cross sectional area at radial position r is given by:

$$r*\int_0^{2\pi} T(r,\phi)d\phi$$

where T(r, ϕ) is the thickness of the base core portion at radial position r and angular position ϕ, (i.e. the azimuth).

With reference to FIGS. 7-10, an arrangement 70 of set of punches and a die, which arrangement may be used in a press for manufacturing an inductor core, and a method of manufacturing an inductor core will be described. Especially, the arrangement 70 and the method may be used to manufacture the pot core 20, described above.

Figure 7:
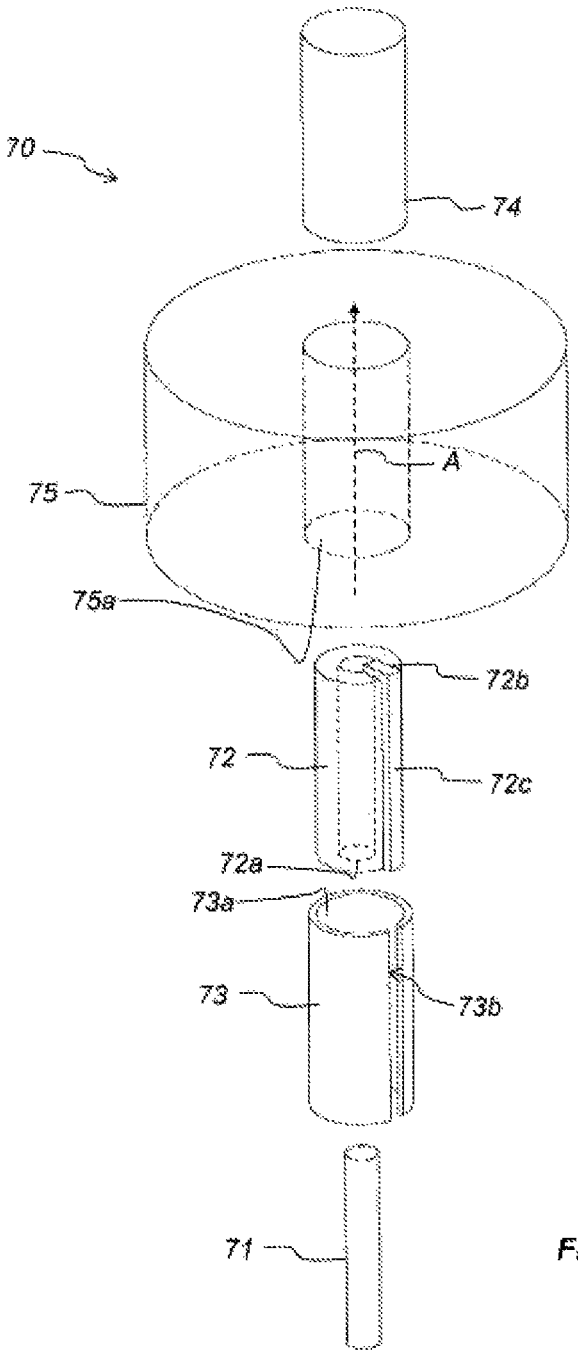
FIG. 7 is an exploded view of an arrangement for a press in accordance with one embodiment.

FIG. 7 is a schematic exploded view of the arrangement 70. To aid understanding of the arrangement 70 and the manufacturing method, reference will also be made to the features of the inductor core 20.

The arrangement 70 includes an inner punch 71, a middle punch 72, an outer punch 73, a counter punch 74 and a die 75. The inner punch 71, the middle punch 72, the outer punch 73 and the counter punch 74 are independently movable along the axial direction A by independently controlled actuators (not shown for clarity). In use, the inner punch 71, the middle punch 72 and the outer punch 73 are configured to apply a pressing force in a first pressing direction coinciding with the axial direction A. The counter punch 74 is configured to apply a pressing force in a second direction directed opposite the first pressing direction, i.e. opposite the axial direction A.

Figure 8:
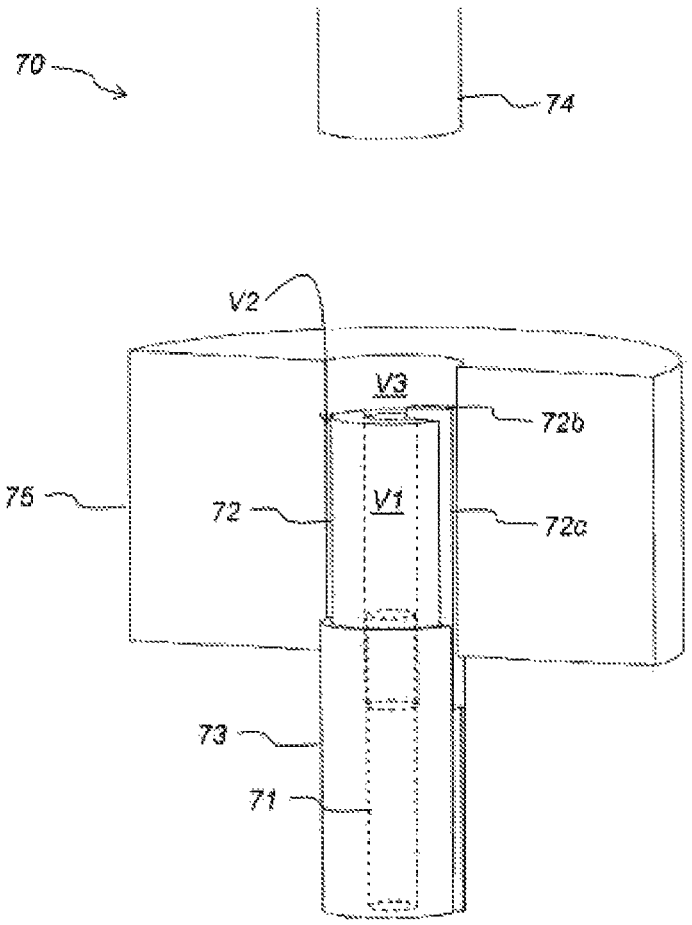
FIGS. 8 and 9 are schematic illustrations of the arrangement in a filling configuration.

FIG. 8 is schematic view of the arrangement 70 with a section of the die 75 cut away. In FIG. 8 the arrangement 70 is illustrated in a configuration allowing soft magnetic powder material to be received in a cavity formed between the punches 71, 72, 73 and the walls of the through-hole 75*a* in the die 75. In the following, this configuration of the arrangement 70 will be referred to as the filling configuration.

The middle punch 72 includes a space 72*a* extending throughout the middle punch and along the direction A. The space 72*a* thus forms an axial through-hole of the middle punch 72. The through-hole 72*a* has a cross sectional dimension, i.e. a radius, exceeding the cross sectional dimension, i.e. a radius, of the inner punch 71. The through-hole 72*a* is arranged to receive the inner punch 71. The inner punch 71 is movable in relation to the middle punch 72. More specifically, the inner punch 71 may slide within the through-hole 72*a*.

The fit between the middle punch 72 and the inner punch 71 is such that substantially no powder may enter between the inner punch 71 and the middle punch 72. Thus, the walls of the through-hole 72*a* and the part of the inner punch 71 received in the through-hole 72*a* define a first partial volume V1 for receiving powder. Hence, the end surface of the inner punch 71 which is facing in the direction A forms the bottom of the volume V1. The first partial volume V1 defines the inner core portion 23 of the inductor core 20.

To enable forming of a recess 24 in the inductor core 20, as will be described in detail in the following, the middle punch 72 presents a first portion 72*b* projecting in the direction A. The first portion 72*b* is arranged to form the recess 24. To enable forming of a slit 25 in the inductor core 20, the middle punch 72 further presents a second portion 72*c* projecting in a radial direction, transverse to the direction A. The second portion 72*c* presents a first side surface and an opposite second side surface. These first and second side surfaces extend in parallel with the direction A. In the embodiment shown in FIG. 7 the first portion 72*b* and the second portion 72*c* are formed together in a single piece.

The outer punch 73 includes a space 73*a* extending throughout the outer punch and along the direction A. The space 73*a* thus forms an axial through-hole of the outer punch 73. The through-hole 73*a* has a cross sectional dimension, i.e. a radius, exceeding the cross sectional dimension, i.e. a radius, of the middle punch 72. The through-hole 73*a* is arranged to receive the middle punch 72.

The outer punch 73 further includes a slit 73*b* extending along the direction A. The slit 73*b* extends through the entire radial thickness of the outer punch 73 and thus extends or opens up into the through-hole 73*a*. The width, i.e. the angular dimension, of the slit 73*b* is such that the slit 73*b* may receive the second portion 72*c*.

The fit between the outer punch 73 and the middle punch 72, and the fit between the slit 73*b* and the second projecting portion 72*c* are such that substantially no powder may enter between the outer punch 73 and the middle punch 72. Also, substantially no powder may enter between the walls defining the slit 73*b* and the side surfaces of the second projecting portion 72*c*.

The die 75 includes a space 75*a* extending throughout the die and along the direction A. The space 75*a* thus forms an axial through-hole of the middle punch 75. The through-hole 75*a* has a cross sectional dimension, i.e. a radius, exceeding the cross sectional dimension, i.e. a radius, of the outer punch 73. However, the fit between the outer punch 73 and the die 75 is such that substantially no powder may enter between the outer walls of the outer punch 73 and the walls of the through-hole 75*a*.

In the filling configuration, the second portion 72*c* of the middle punch 72 extends towards the inner wall of the through-hole 75*a* of the die 75. The fit between the middle punch 72 and the die 75 is such that powder may enter between the outer walls of the middle punch 72 and the walls of the through-hole 75*a* of the die 75 however substantially no powder may enter between the second portion 72*c* and the wall of the through-hole 75*a*.

Thus, the walls of the through-hole 75*a*, the outer walls of the middle punch 72 and the second portion 72*c* together define a second partial volume V2 for receiving powder. The second partial volume V2 is further defined by the part of the outer punch 73 surrounding the middle punch 72. Thus, the end surface of the outer punch 73 which is facing in the direction A forms the bottom of the volume V2. The second partial volume V2 defines the outer core portion 22 of the inductor core 20.

The partial volume V2 extends in a circumferential direction from the first side surface of the second portion 72*c*, through the space between the outer walls of the middle punch 72 and the walls of the through-hole 75*a*, to the second side surface of the second portion 72*c*, opposite the first side surface of the second portion 72*c*. The partial volume V2 thereby forms an annular space partly surrounding the middle punch 72, wherein powder material is prevented from entering the space occupied by the second portion 72*c*.

The walls of the through-hole 75*a*, the end surface of the middle punch 72 facing in the direction A, and the projecting portion 72*b* together define a third partial volume V3 for receiving powder. The third partial volume V3 defines the base core portion 21 of the inductor core 20, which base core portion 21 includes a recess 24.

The first partial volume V1 communicates with the second partial volume V2 via the partial volume V3. The partial volumes V1, V2 and V3 together define a cavity for receiving powder to be compressed into an inductor core.

Figure 9:
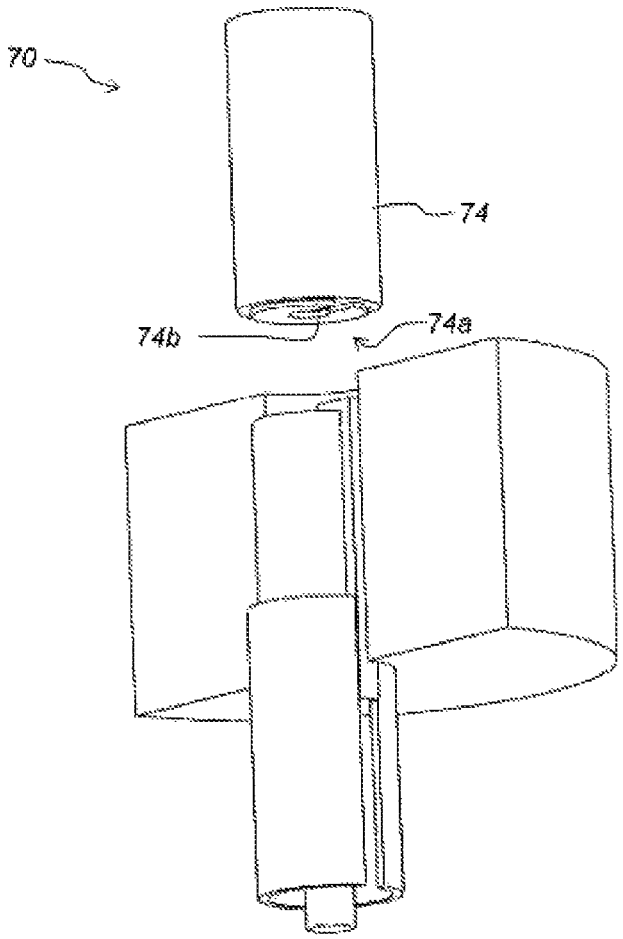

FIG. 9 illustrates the arrangement 70 in the filling configuration from a slightly different angle, wherein an end surface 74*a* of the counter punch 74 is visible. The end surface 74*a* includes a depression 74*b* for forming a protrusion 27 on the inductor core 20. The depression 74*b* is arranged to be aligned with the first portion 72*b* of the middle punch 72.

The surface 74*a* of the counter punch 74 includes further depressions arranged to form inductor cores including an optional center protrusion and an optional rim protrusion, similar to center protrusion 28 and rim protrusion 29 in FIG. 2*b*. The surface 74*a* is hence arranged to form an inductor including a common protruded surface, as illustrated in FIG. 2*b*, including a protrusion 27, a center protrusion 28 and a rim protrusion 29. Hence, the surface 74*a* may alternatively and analogously be described as a surface 74*a* presenting one or more projections for forming the parts of the second surface 21*b* which not are to present any protrusion.

Optionally, the inner punch 71 may include an axially extending hole and an additional punch, wherein the hole of the inner punch 71 is arranged to receive the additional punch. The additional punch may be used to form an axially extending through-hole in the inner core portion 23.

Figure 10:
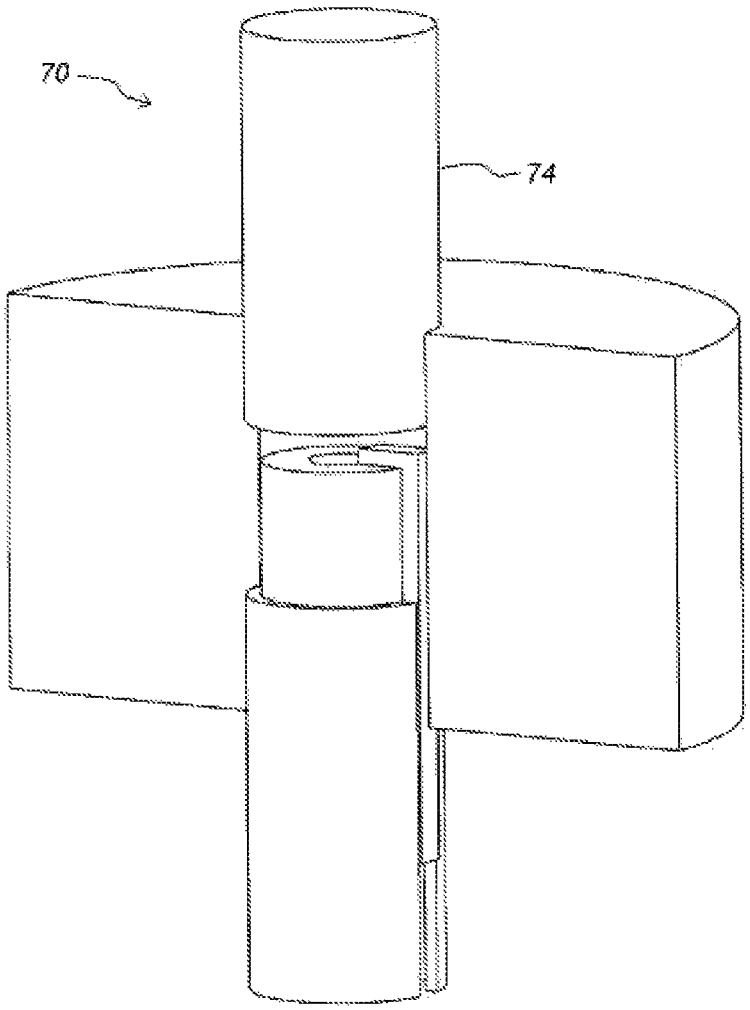
FIG. 10 is a schematic illustration of the arrangement in a pressing configuration.

With the arrangement 70 assuming the filling configuration, the cavity thus formed is filled with the powder to be compressed. The powder is received through the upper opening of the cavity, formed by the upper opening of the through-hole 75*a* in the die 75. The powder may be any of the powders discussed in connection with the inductor core 20. After a desired amount of powder has been provided in the cavity, each one of the inner punch 71, the middle punch 72 and the outer punch 73 are brought to apply a pressing force in the upward axial direction A. The counter punch 74 is brought to apply an opposite pressing force in the downward axial direction. The configuration assumed by the arrangement may be referred to as the pressing configuration and is illustrated in FIG. 10. The powder in the first, the second and the third partial volumes may thus be simultaneously compressed along the axis A to form the inductor core 20.

The first projecting portion 72*b* thus forms a recess 24 in the base portion 21 of the inductor core 20 and the surface 74*a* of the counter punch 74 forms a corresponding protrusion 27. The second projecting portion 72*c* prevents powder from entering between the second projecting portion 72*c* and the wall of the through-hole 75*a* of the die 75 and thus forms the slit 25.

The inductor core may thus be provided with both a recess 24 and a slit 25 in a single pressing operation and without any aftermachining. By virtue of the design of the surface 74*a* of the counter punch 74, reduced density variations and thus even loading of the middle punch 72 may be ensured despite the presence of the first projecting portion 72*b*.

Had the surface 74*a* not been provided with a depression 74*b*, the first projecting portion 72*b* would cause a higher degree of compaction of the powder layer above the portion 72*b* than the degree of compaction of the powder layer over the other parts of the pressing surface of the middle punch 72. Such local over-compaction could bias the middle punch 72 thereby forcing the first projecting portion 72*b* and/or the second projecting portion 72*c* through the slit 73*b* and into the walls of the through-hole 75*a*, thereby damaging the die 75. This risk would become even larger as the pressing forces are increased. Thus the arrangement 70 makes it possible to obtain an inductor core having an increased density in the base core portion compared to pressed inductor cores which are commercially available today.

Although an inductor core and an arrangement of a set of punches and a die, having circular cross sections have been described in the above, the inventive concept is not limited to this specific shape. For example, the inductor core may present an elliptical cross section, a rectangular cross-section, a polygonal cross section etc without departing from scope of the present inventive concept, as defined in the independent claims.

The invention claimed is:

1. An inductor core made of a compressed soft magnetic powder material, comprising:

a base core portion having a first surface and an opposite second surface;

an inner core portion extending from the first surface in a direction transverse to the first surface;

an outer core portion extending, in the direction transverse to the first surface, from the first surface to an end surface of the outer core portion, the outer core portion at least partly surrounding the inner core portion, thereby forming a space around the inner core portion for accommodating a winding;

wherein the first surface comprises a recess for accommodating a connection portion of the winding, said recess extending at least a part of a distance between the inner core portion and the outer core portion, and wherein the outer core portion presents a slit extending from said end surface towards the recess, and wherein the second surface comprises a first protrusion oppositely arranged to the recess, wherein the second surface further comprises a center protrusion arranged directly opposite the inner core portion.

2. An inductor core according to claim 1, wherein said first protrusion is coextensive with at least a part of said recess.

3. An inductor core according to claim 1, wherein said first protrusion extends to an outer edge of the second surface of the base core portion.

4. An inductor core according to claim 1, wherein the recess extends from the inner core portion.

5. An inductor core according to claim 1, wherein the recess extends to an outer edge of the first surface of the base core portion.

6. An inductor core according to claim 5, wherein the slit extends to the recess such that the slit joins the recess wherein the recess forms the bottom of the slit.

7. An inductor core according to claim 1, wherein the wall portions of the outer core portion defining the slit extend in parallel with the direction transverse to the first surface.

8. An inductor core made of a compressed soft magnetic powder material, comprising:

a base core portion having a first surface and an opposite second surface;

an inner core portion extending from the first surface in a direction transverse to the first surface;

an outer core portion extending, in the direction transverse to the first surface, from the first surface to an end surface of the outer core portion, the outer core portion at least partly surrounding the inner core portion, thereby forming a space around the inner core portion for accommodating a winding;

wherein the first surface comprises a recess for accommodating a connection portion of the winding, said recess extending at least a part of a distance between the inner core portion and the outer core portion, and wherein the outer core portion presents a slit extending from said end surface towards the recess, and wherein the second surface comprises a first protrusion oppositely arranged to the recess, wherein the wall portions of the outer core portion defining the slit extend in parallel with the direction transverse to the first surface, wherein said first protrusion extends between the center protrusion and an outer edge of the second surface of the base core portion, said first protrusion thereby joining the center protrusion.

9. An inductor core according to claim 8, wherein an extension of said first protrusion in a direction transverse to the second surface meets an extension of the inner core portion in the direction transverse to the second surface.

10. An inductor core made of a compressed soft magnetic powder material, comprising:

a base core portion having a first surface and an opposite second surface;

an inner core portion extending from the first surface in a direction transverse to the first surface;

an outer core portion extending, in the direction transverse to the first surface, from the first surface to an end surface of the outer core portion, the outer core portion at least partly surrounding the inner core portion, thereby forming a space around the inner core portion for accommodating a winding;

wherein the first surface comprises a recess for accommodating a connection portion of the winding, said recess extending at least a part of a distance between the inner core portion and the outer core portion, and wherein the outer core portion presents a slit extending from said end surface towards the recess, and wherein the second surface comprises a first protrusion oppositely arranged to the recess, wherein the second surface further comprises a rim protrusion extending along an outer edge of the second surface of the base core portion.

11. An inductor core according to claim 1, wherein the first surface comprises at least two recesses, said at least two recesses extending at least a part of a distance between the inner core portion and the outer core portion, and wherein the second surface, for each of said at least two recesses, comprises a protrusion oppositely arranged to a corresponding recess.

12. An inductor core made of a compressed soft magnetic powder material, comprising:

a base core portion having a first surface and an opposite second surface;

an inner core portion extending from the first surface in a direction transverse to the first surface;

an outer core portion extending, in the direction transverse to the first surface, from the first surface to an end surface of the outer core portion, the outer core portion at least partly surrounding the inner core portion, thereby forming a space around the inner core portion for accommodating a winding;

wherein the first surface comprises a recess for accommodating a connection portion of the winding, said recess extending at least a part of a distance between the inner core portion and the outer core portion, and wherein the outer core portion presents a slit extending from said end surface towards the recess, and wherein the second surface comprises a first protrusion oppositely arranged to the recess, wherein a density in a part of the base core portion including a recess differs from a density in a part of the base core portion not including any recess by 10% or less.

* * * * *